US006354511B1

(12) United States Patent
Hardee

(10) Patent No.: US 6,354,511 B1
(45) Date of Patent: Mar. 12, 2002

(54) PORTABLE SYSTEM FOR HEATING WATER

(75) Inventor: Mitchell C. Hardee, Myrtle Beach, SC (US)

(73) Assignee: Hardee Enterprises, Conway, SC (US)

( * ) Notice: Subject to any disclaimer, the term of this patent is extended or adjusted under 35 U.S.C. 154(b) by 0 days.

(21) Appl. No.: 09/437,889

(22) Filed: Nov. 9, 1999

(51) Int. Cl.[7] ..... F24D 3/08

(52) U.S. Cl. ..... 237/19; 237/8 R; 126/205; 236/20 R

(58) Field of Search ..... 237/19, 8 R, 8 D; 126/205, 427, 362; 236/20 R, 21 B, 22

(56) References Cited

U.S. PATENT DOCUMENTS 3,431,565 A * 3/1969 Nelson ..... 126/205
3,768,458 A * 10/1973 Williams ..... 126/350 R
4,761,840 A * 8/1988 Harding ..... 4/664
4,996,970 A * 3/1991 Legare ..... 126/205
5,020,721 A * 6/1991 Horne ..... 236/20 R
5,852,836 A * 12/1998 Montrose ..... 4/603

* cited by examiner

*Primary Examiner*—Harold Joyce
*Assistant Examiner*—Derek S. Boles
(74) *Attorney, Agent, or Firm*—Mitchell C. Hardee

(57) ABSTRACT

The present invention provides an apparatus for heating water. In certain embodiments, the present invention relates to a portable apparatus for heating water that may also be self-contained such that connection to additional sources of fuel or electrical power are not required. Certain embodiments of the present invention may be used to provide heated water for showers, cleaning, food preparation, and the like.

34 Claims, 5 Drawing Sheets

PORTABLE SYSTEM FOR HEATING WATER

FIELD OF THE INVENTION

The present invention relates to an apparatus for heating water. More particularly, the present invention relates to a portable apparatus for heating water that may also be self-contained. In certain embodiments, the present invention may used to provide heated water for showers, cleaning, food preparation, and the like.

BACKGROUND OF THE INVENTION

Heated water is expected by many to be readily available under circumstances that may range from simple convenience to practical necessity. With usage varying from bathing to hot food, there is a demand for heated water over a broad range of temperatures and volumes. Consequently, water heaters and piping are installed as permanent fixtures for water delivery in homes, offices, and industrial settings. Faucets supplying heated water may be installed in fixed locations at anticipated points of use.

For some applications, a portable system for heating water may be required. Soldiers in the field may establish remote, temporary camps needing a portable water supply with heating capability. Requirements for military readiness and mobility may dictate that equipment should not be bulky, cumbersome, or difficult to unpack and setup. Similarly, campers may plan extended outdoor events in areas with water but limited or no access to heated water. Pet owners may wish to bathe an animal outside of the home but may not have an outdoor faucet supplying heated water.

Furthermore, permanent fixtures for the delivery of heated water remain unavailable in parts of the world. The infrastructure necessary for water delivery from a central location to individual homes and businesses may not be available. Elsewhere, a readily available water supply may exist but without fixtures for heating or an energy source to provide the heat.

Thus, an apparatus capable of heating water that is portable and that may be self-contained is desirable. Self-contained, as used with the present invention, means an apparatus capable of heating the water without requiring connection to an external or remote power source or remote fuel source. An apparatus that can also rapidly heat water without requiring storage in insulated tanks or containers would be an added benefit for portability.

Various devices for heating water exist. As the following examples demonstrate, the portability and degree of self-containment varies. U.S. Pat. No. 5,524,820, issued to Regan, discloses a device described as a portable water heater unit for field use. The device includes a housing containing a water heater and uses a heated water storage tank. An external supply of a flammable liquid fuel provides an energy source for heating. A pump and various controls are powered by an external power supply—i.e. the device must be plugged into a generator, external battery, or receptacle for operation. Accordingly, the portability of this device is delimited by the requirement that external equipment must be used in the disclosed embodiments.

U.S. Pat. No. 4,947,025, issued to Alston et al., discloses a portable electric water heater. The device contains a coiled water conducting tube and a rheostat for varying the amount of current supplied to the electric heating element. The power supply for the electric heating element is external to the device and serves to limit its portability.

U.S. Pat. No. 4,552,125 issued to Borodulin et al, discloses a portable solar water heater. The device includes a table containing solar collector panels for heating water when exposed to solar radiation. By definition, this device is limited to use during time periods when solar energy is available.

Numerous references disclose outdoor showering equipment, but each assumes either a separate device for supplying heated water, or an external power source for heating the water. U.S. Pat. No. 5,774,908, issued to Hall, discloses an outdoor shower with a chamber for holding water to be heated by solar energy. U.S. Pat. No. 5,920,927, issued to Thomas, discloses a combined portable shower and toilet assembly without a means for heating the water within the device. U.S. Pat. No. 5,911,520, issued to Kenney, discloses a portable shower apparatus with a vessel for storing water that can also be pressurized. Water of the desired temperature is placed into the vessel without an internal means for heating the water. U.S. Pat. No. 5,852,836, issued to Montrose, discloses a portable shower with water that is dispensed from a container within the apparatus. Water is placed into the container at the desired temperature without an internal means for heating.

Accordingly, a need exists for a portable apparatus that can provide for heating water. An apparatus that is portable and also self-contained is also needed. Specifically, there is a need for an apparatus that can heat water over a wide range of volumes and temperatures while minimizing the weight and space of the apparatus. The apparatus should also have an embodiment that can provide heated water without requiring connection to an external fuel supply or power source that is not equipped with the apparatus.

SUMMARY OF THE INVENTION

The present invention is directed to water heater that is portable and has a minimum of weight and requires minimal space. In specific embodiments, the present invention is also self-contained in that connection to an external power or fuel source is not required for heating water. The storage of heated water within tanks that add weight and consume space is also not required. The present invention also provides an apparatus that may be used to heat water for showering, cleaning, food preparation, and other applications where heated water is desired. The apparatus is not limited to heating water, and may be used by those skilled in the art with the teachings disclosed herein to heat other aqueous fluids that are non-flammable and that are not otherwise sensitive to the application of heat.

Specific embodiments of the present invention may be used in applications where a minimum of space is available. Accordingly, embodiments of the present invention may be installed into boats, campers, or other transportation vessels to provide heated water for showers, sinks, and the like. These embodiments may connect to an existing fuel source or power supply at the point of installation.

Furthermore, certain embodiments of the present invention may also be self-contained and of a size that can be easily transported by a single person. Thus, embodiments of the present invention may be used by soldiers, campers, sportsmen, or others desiring a portable and self-contained apparatus for heating water. For these embodiments, a fuel source or energy source may be provided with the apparatus so that connection to an external fuel supply or electrical power source is not necessary. A handle may also be provided in these embodiments for transporting the apparatus.

In one particular embodiment, the present invention includes a housing with a water inlet conduit, through which water to be heated may enter the housing. A pump is located within the housing. The pump has a supply section and a discharge section. The supply section of the pump is in fluid communication with the water inlet conduit. A battery is also located within the housing for providing power to operate the pump.

A heat exchanger is located within the housing that has an inlet section and an outlet section. The inlet section is in fluid communication with the discharge section of the pump. The heat exchanger preferably includes a conically-shaped interior coil. The conically-shaped interior coil is constructed of conduit and has a first end and a second end. The diameter of the conically-shaped interior coil decreases along the coil axis from the first end to the second end of the coil. The heat exchanger also includes a cap that is located proximate to the second end of the conically-shaped interior coil. The heat exchanger has an exterior coil constructed of conduit that is in fluid communication with the conically-shaped interior coil and the outlet section of the heat exchanger. A water outlet conduit is provided that is in fluid communication with the outlet section of the heat exchanger. Heated water may exit the housing of the water heater through the water outlet conduit.

The water heater includes a fuel inlet section, releasably connectable to a fuel source, through which fuel may be supplied to the water heater. A gaseous fuel control system is provided for controlling the flow of fuel from the fuel inlet section. A burner section, located in the housing, is provided for generating heat from fuel supplied to the water heater. The gaseous fuel control system connects the fuel inlet section to the burner section.

The gaseous fuel control system includes a valve that is located subsequent in flow to the fuel inlet section. An orifice, having an effective diameter in the range of about 0.010 to about 0.030 inch, is in communication with the valve. A port, also having an effective diameter in the range of about 0.010 to about 0.030 inch, is also in communication with the valve. During operation, fuel flows from the fuel inlet section and through the valve, then through the first orifice, and then through the port.

Accordingly, by way of example only and using the embodiment above described, to provide heated water from the portable water heater, the fuel inlet section is connected to a fuel supply through the resealable connection. The water inlet conduit is connected to or immersed into a water supply. If the water is not already pressurized, the pump is powered by connecting it to the battery. After obtaining flow of the water from the water outlet conduit, the burner section is ignited and begins to create heat through combustion of the fuel.

Unheated water enters the housing through the water inlet conduit and then flows to the supply section of the pump. When the pump is powered, the pump causes water to flow through the discharge section of the pump and into the inlet section of the heat exchanger. As the water travels through the coils of the heat exchanger, the temperature of the water increases from heat generated by the burner section. Heated water flows through the outlet section of the heat exchanger and is then released from the housing through the water outlet conduit. The valve may be adjusted to vary temperature of the water to enable one to obtain heated water at a desired temperature.

This description of an embodiment of the present invention is provided by way of example only. Various other embodiments exist and may be practiced using the teachings disclosed herein. By way of example only, the water outlet conduit may be connected to a shower head so that the apparatus may be used to heat water for bathing. Alternatively, in another embodiment, the present invention may include only a burner section, gaseous fuel control system, and fuel inlet section. Such an embodiment might be installed within the heated water system of a boat or camper to provide a heat source requiring only a minimum of space. In addition, the pump, switch, battery and fuel source may also be included, but without the housing, so as to provide a water heater that is self-contained but occupying a minimum of space.

These and other features, aspects and advantages of the present invention will become better understood with reference to the following description and appended claims. The accompanying drawings, which are incorporated in and constitute a part of this specification, illustrate an embodiment of the invention and, together with the description, serve to explain the principles of the invention.

DETAILED DESCRIPTION OF THE PREFERRED EMBODIMENTS

Reference now will be made in detail to the embodiments of the invention, one or more examples of which are set forth below. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment, can be used on another embodiment to yield a still further embodiment. Thus, it is intended that the present invention cover such modifications and variations as come within the scope of the appended claims and their equivalents. Other objects, features and aspects of the present invention are disclosed in or are obvious from the following detailed description. It is to be understood by one of ordinary skill in the art that the present discussion is a description of exemplary embodiments only, and is not intended as limiting the broader aspects of the present invention.

Generally, the present invention relates to an apparatus for heating water. In particular embodiments, the present invention relates to a portable apparatus that may also be self-contained in that connection to an external fuel or electrical power source is not necessary to heat water. Alternatively, embodiments of the present invention may be connected to the fuel source or power source of an existing system to provide a portable and space saving water heater. Embodiments of the present invention may be used for providing heated water for bathing, cleaning, food preparation, and the like. In addition to water, the invention may also be used for heating other aqueous nonflammable solutions that are not otherwise adversely sensitive to the application of heat.

Figure 1:
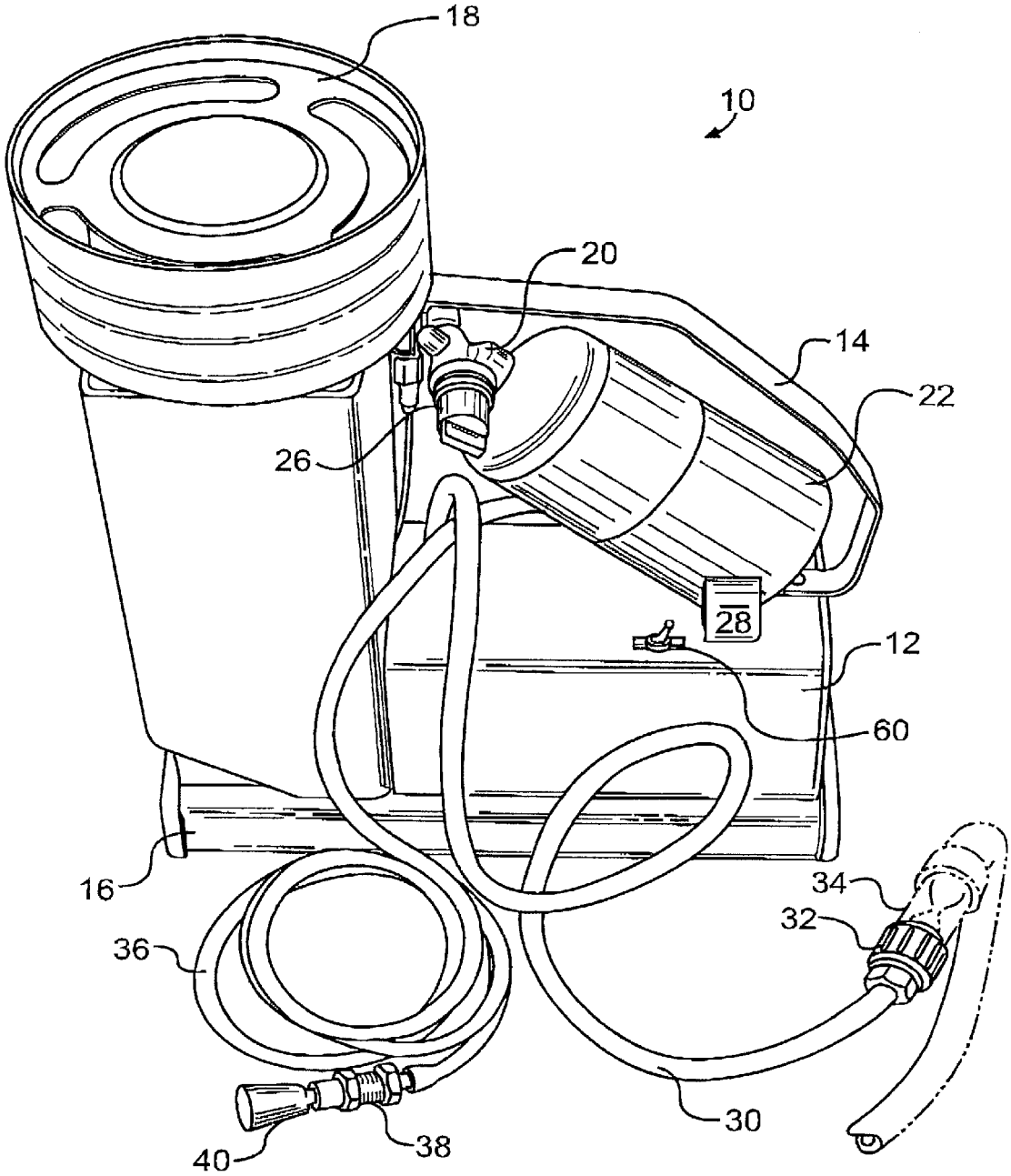
FIG. 1 is a perspective view of an embodiment of the present invention.

Referring now to FIG. 1, an embodiment of the water heater generally 10 is depicted with a housing 12 and a handle 14 for carrying the apparatus. Housing 12 may be constructed of any material that is suitable for protecting the internal components of the heater 10 and that is compatible with the intended use. For example, materials of construction may include various metals, plastics, composites, and the like. The shape of housing 12 is not limited to that depicted in FIG. 1. Various shapes and sizes may be envisioned that protect the apparatus, provide stability during use, and that may also facilitate transport, storage, and use. A base 16 may also be included to further stabilize the apparatus and may be modified to shapes that facilitate use or installation of heater 10 in specific applications. Base 16 may include an aperture (not shown) for draining condensate away from the housing during operation of the water heater 10. Similarly, handle 14 may be variously shaped and constructed of materials that are suitable for the lifting and handling of heater 10. These materials include various metals, plastics, and the like.

A vent cap 18 is included to dissipate heat and gas created by the combustion of fuel. Preferably, vent cap 18 is shaped and constructed such that its surface temperature is minimized during operation of heater 10. Accordingly, vent cap 18 may be any number of shapes and configurations in addition to that depicted in FIG. 1. Alternatively, vent cap 18 may be replaced with a pipe or conduit for transporting released heat and gas away from the water heater 10. This may be desirable or required for applications where the water heater 10 is being used in semi-enclosed locations.

Figure 2:
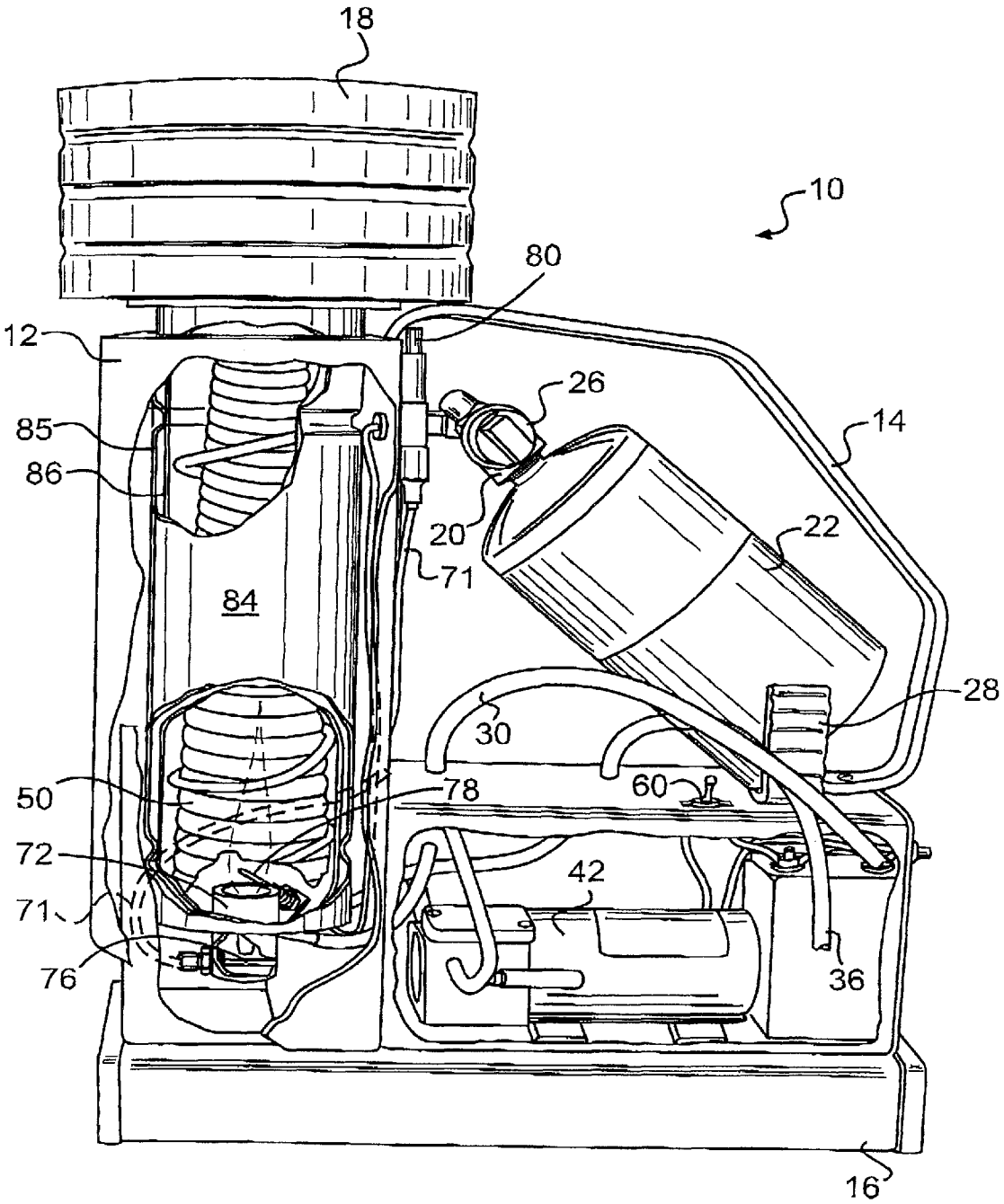
FIG. 2 is a perspective and partial cross-sectional view of the embodiment of the present invention depicted in FIG. 1.
Figure 4:
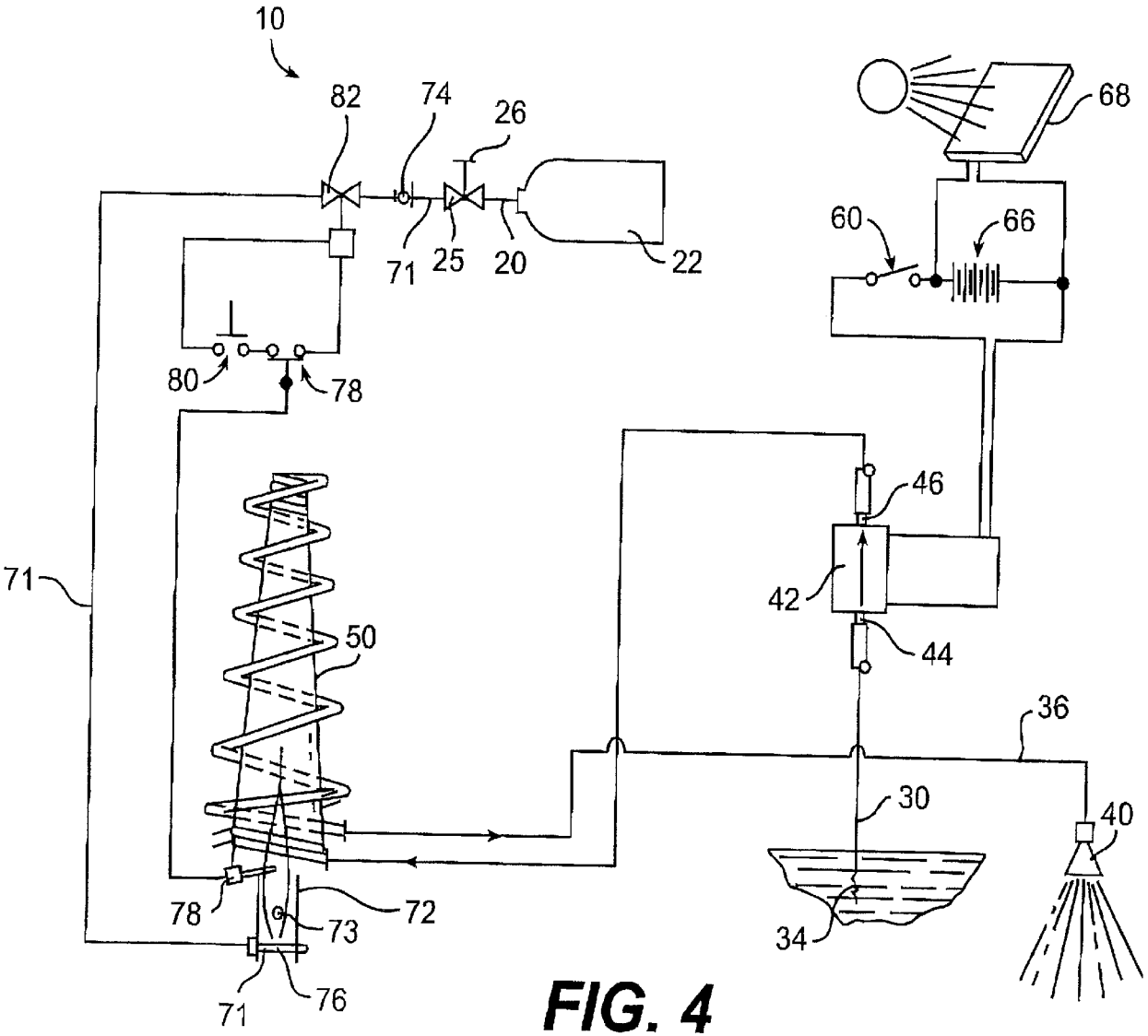
FIG. 4 is a schematic representation of an embodiment of the present invention.

Referring now to FIG. 1, FIG. 2, and FIG. 4, a fuel inlet section 20 is provided that is resealably connectable to a fuel source 22. Fuel source 22 may be selected from any flammable fuels that will safely operate in the apparatus. For example, propane fuel may be used with the embodiment depicted in FIG. 1 and FIG. 2. A gaseous fuel control system is used to control the flow of fuel and includes a valve 25, located subsequent in flow to fuel inlet section 20, and activated through an actuator 26. Valve 25 and the fuel inlet section 20 may be formed together as one piece as depicted in FIG. 1 and FIG. 2, or may be two separate pieces. The fuel inlet section 20 is resealably connectable to a fuel source 22. Accordingly, fuel inlet section 20 may be a connectable conduit, a threaded conduit, an O-ring connector, a threaded base with an aperture, and the like for connecting to the fuel source 22 using a connection that is resealable and that will not allow a fuel leak.

Fuel source 22 may be positioned on the housing 12 as shown or may be contained within the housing 12. In order to facilitate replacement and transport of the fuel source 22, fuel source 22 is shown attached to the surface of the housing 12 by a suitable bracket 28. When mounting the fuel source 22 outside of the housing 12, the bracket 28 and fuel source 22 may be located anywhere upon the housing. FIG. 1 shows a location that facilitates access to fuel source 22 while minimizing the volume and footprint occupied by water heater 10.

Water to be heated may enter the housing 12 through a water inlet conduit 30, and preferably is constructed from a flexible material. By way of example, inlet conduit 30 may be constructed from a polymer such as polyvinyl chloride tubing or polyvinyl chloride pipe, from copper tubing, or the like. A threaded connector 32 may be attached to one end of water inlet conduit 30 to allow connection to conventional fittings such as a faucet. Alternatively, for those embodiments that include a pump, threaded connector 32 may not be necessary since conduit 30 may simply be immersed into the water to be heated, such as a river, stream, lake, container of water, or the like. A strainer (not shown) may be located within water inlet conduit 30 or connector 32 to remove particulate matter from the unheated water supply.

A flow restrictor 34 may be used to regulate the flow of water into the water inlet conduit 30. As shown in FIG. 1, a restrictor 34 may be connected to a pressurized water supply using threaded connector 32.

The pressure of the water supply may be adequate to operate the water heater 10 without using a pump 42 within the housing 12. However, a high pressure supply may cause a flow rate through the housing 12 that does not allow enough residence time within the housing 12 for heating the water to the desired temperature. Accordingly, flow restrictor 34 may be used to restrict the rate of flow to a level where the water may be heated to the desired temperature in a single pass through the heat exchanger. The flow restrictor 34 may be connected to conduit 30 as shown in FIG. 1, or otherwise located.

Heated water exits housing 12 through a water outlet conduit 36. As with water inlet conduit 30, the water outlet conduit 36 may be constructed from any material suitable and compatible with the water to be heated. The embodiment depicted in FIG. 1 shows water outlet conduit 36 constructed from flexible tubing, and with a threaded connector 38 attached to the end thereof for connection to a shower head 40 or other water dispenser. Shower head 40 may be equipped with a variable flow valve for controlling the flow, and therefore also the temperature, of the heated water. A variety of shower heads may be utilized to produce differently shaped streams of heated water exiting the water heater 10 through the water outlet conduit 36. Accordingly, the water heater 10 may be used for bathing, showering, washing, food preparation, and the like.

A control switch 60 may also be included with the water heater 10 for operating or controlling the pump. While a conventional off/on switch is illustrated in the figures, a push-button switch, toggle switch, dial, or the like may be employed. Furthermore, control switch 60 may include a rheostat or other variable control by which the speed of the pump 42 and therefore the temperature of the water may be varied.

Referring now to FIG. 2 and FIG. 4, water inlet conduit 30 is shown in fluid communication with a supply section 44 of the pump 42. Pump 42 may be provided for applications where the unheated water is not adequately pressurized. For example, water heater 10 may be used by simply immersing water inlet conduit 30 into a container of water. Pump 42 may draw the water from the container, through the water inlet conduit 30 and into the supply section 44 of the pump 42. The pump 42 then discharges the water through a discharge section 46 of the pump 42.

Pump 42 may be constructed such that water heater 10 may be used with both a supply of water that is pressurized, or a supply of water that is not pressurized. For example, pump 42 may be structured such that when it is powered, water will be drawn from its source through water inlet conduit 30. Alternatively, when water inlet conduit 30 is connected to a pressurized water supply, such as a water faucet, pump 42 will allow water to pass even when pump 42 is not powered. A preferred pump for use according to the present invention is a manual demand pump that will allow flow through even when the pump 42 is not powered, such as a Flojet, Model LF122002C manufactured by Flojet Corporation.

As depicted in FIG. 4, pump 42 may be powered by a battery 66 or any other sufficient power source. A solar panel recharger 68 may be included to recharge the battery 66. A solar panel (not shown) may also be connected to power the pump without requiring power from the battery 66.

Figure 3:
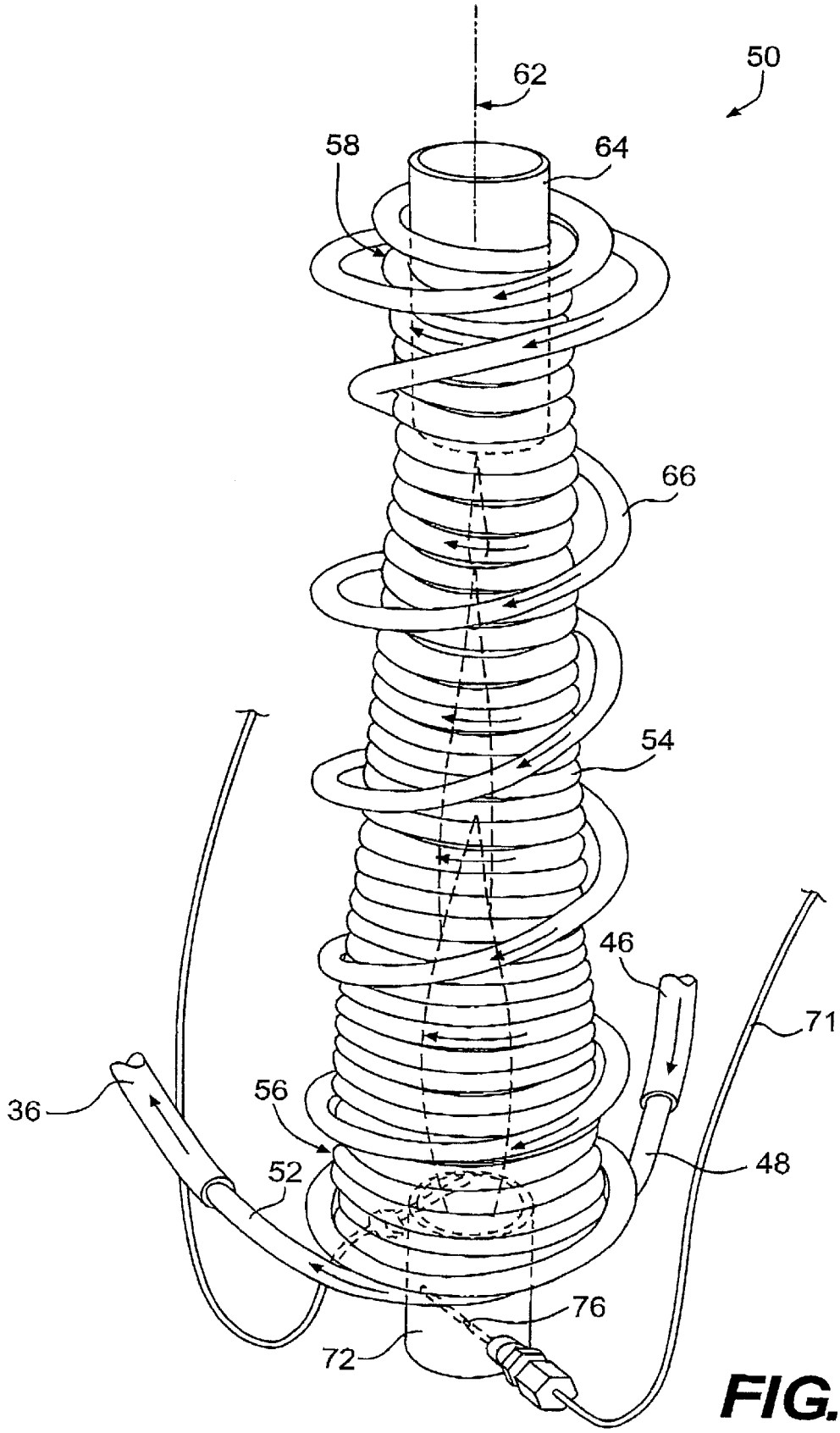
FIG. 3 is a perspective view of a preferred embodiment of a burner section and heat exchanger according to the present invention.

Referring now to FIGS. 2–4, the discharge section 46 of pump 42 is in fluid communication with an inlet section 48 of a heat exchanger 50. As depicted in FIG. 3, heat exchanger 50 preferably includes a conically-shaped interior coil 54 having a first end generally 56 and a second end generally 58 and being constructed of conduit. Conically-shaped coil 54 decreases in diameter along the coil axis 62 from the first end 56 to the second end 58. A cap 64 is located proximate to the second end 58 of coil 54, and generally plugs the space within coil 54. An exterior coil 66, preferably a continuation of coil 54, is located exterior to conically-shaped interior coil 54 and is in fluid communication therewith. Exterior coil 66 is also in fluid communication with an outlet section 52 of heat exchanger 50. From the outlet section 52, heated water flows into the water outlet conduit 36, and exits heater 10.

Accordingly, as indicated by the arrows in FIG. 3 showing flow through the conduit, water to be heated enters heat exchanger 50 through inlet section 48, travels through conically-shaped interior coil 54 and exterior coil 66, and exits heat exchanger 50 through outlet section 52.

Heat exchanger 50 and cap 64 may be constructed of any material that will withstand the heat generated by combustion of the fuel and that will efficiently transfer heat to the water. This material should also be capable of manufacture into the described coil shapes. Suitable materials include steel, copper, and the like. Overall dimensions of heat exchanger 50 may be varied while adhering to the description herein provided. Cap 64 may be shaped as depicted in FIG. 3 or may take any form that provides a restriction to the flow of heated gas from the second end 58 of interior coil 54.

As shown in FIG. 2, heat exchanger 50 may be enclosed by a vent pipe 84 located within the housing 12. Vent pipe 84 serves to insulate heat exchanger 50 and to direct combustion gases towards the vent cap 18. Preferably, vent pipe 84 is double-walled as at 85, 86 to provide additional insulation. Materials such as steel, aluminum, or other materials that will withstand the heat of combustion may be used for the vent pipe 84.

Referring to FIGS. 2–4, the heat exchanger 50 may be heated through the combustion of fuel in a burner section 72. Burner section generally 72 is located within the housing 12 and proximate to inlet section 48 of heat exchanger 50. Fuel is supplied to burner section 72 from fuel source 22 via a gaseous fuel control system that also serves to control the flow of fuel. The gaseous fuel control system includes valve 25, and conduits which contain an orifice 74, and a port 76. Valve 25 is located subsequent in flow to fuel inlet section 20. From fuel inlet section 20, fuel flows through valve 25, then through orifice 74 in conduit 71, and then through port 76 in conduit 71 . Orifice 74 has an effective diameter in the range of about 0.010 inch to about 0.030 inch, and preferably about 0.013 inch. Port 76 has an effective diameter in a range of from about 0.010 inch to about 0.030 inch, preferably about 0.018 inch.

Port 76 is in communication with a burner section 72 whereby fuel flows through port 76 into burner section 72 where the fuel is mixed with air and ignited. Combustion of the fuel releases heat for raising the temperature of water within the conduit of the heat exchanger 50.

Figure 5:
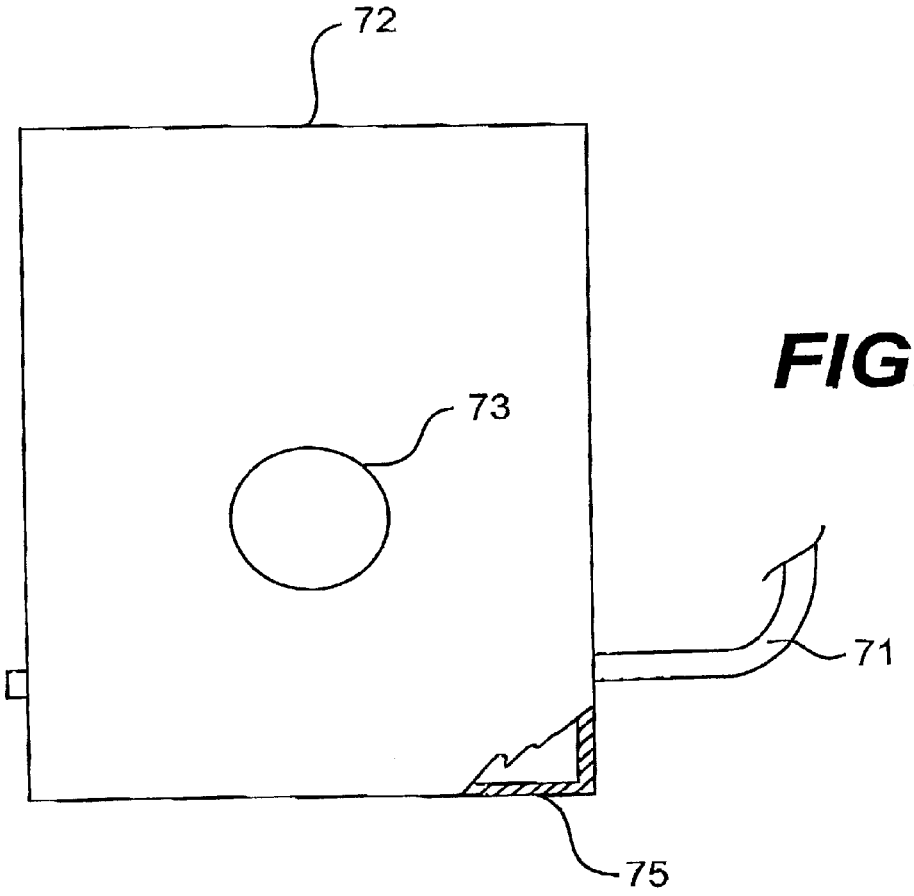
FIG. 5 is a side elevational view of the preferred embodiment of the burner section depicted in FIG. 3.
Figure 6:
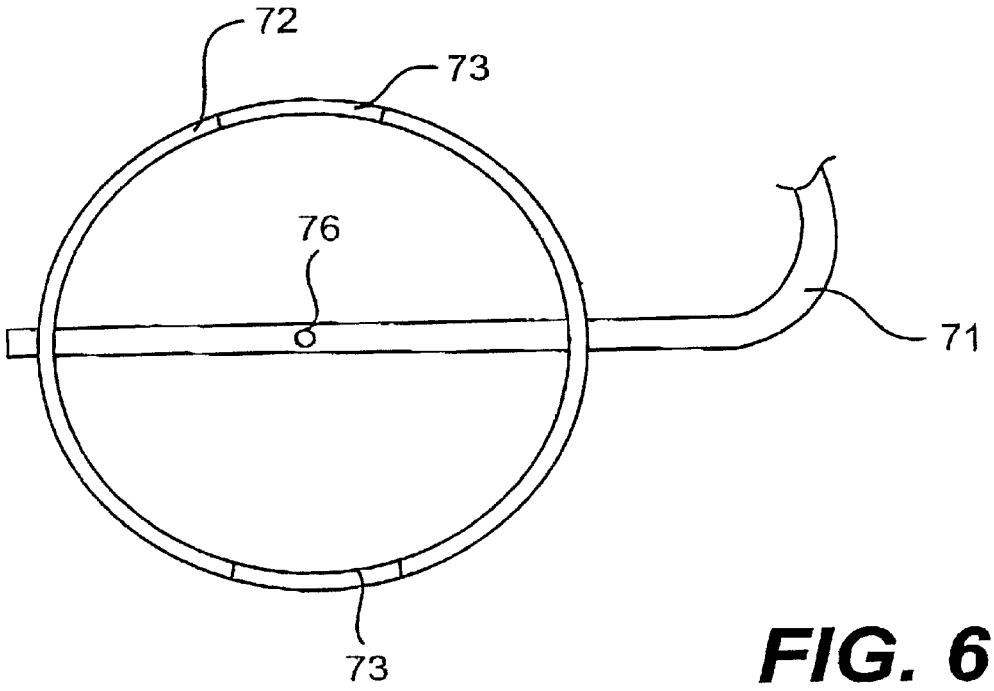
FIG. 6 is a top view of the preferred embodiment of the burner section depicted in FIG. 3.

Referring to FIGS. 2, 5, and 6, burner section 72 may be circular as depicted or may take any shape capable of allowing the air to be mixed with fuel for proper combustion. Burner section 72 may also include one or more apertures 73, located on side walls of same, with apertures 73 having effective diameters of about 0.25 to about 0.5 inch. Preferably, burner section 72 includes two such opposing apertures 73.

Burner section 72 may have any height and diameter combination that provides for efficient combustion of the fuel. Preferably, burner section 72 has an effective diameter of about 0.5 inch to about 3 inches and an effective length of no less than about 0.5 inch. Still more preferably, burner section 72 has an effective diameter of about 1 inch and an effective length of about 2.5 inches, with two apertures 73 each having an effective diameter of about 5/16 inch.

Burner section 72 may be constructed of any material capable of withstanding the heat generated by combustion of the fuel, such as copper, steel, ceramic materials, or the like. Conduit 71 is preferably positioned with respect to burner section 72 so as to locate port 76 within the burner section 72 as depicted in FIGS. 2–6, or may be located proximate to the burner section 72 for the release of fuel into the burner section 72. Additionally, burner section 72 may be closed by a bottom 75 as depicted in FIG. 5, or may be left open. If burner section 72 is closed by bottom 75, an opening may be made to allow the release of condensate.

Referring to FIG. 2 and FIG. 4, the gaseous fuel control system may also include a thermocouple 78, a pilot switch 80, and a shut-off valve 82. During operation, thermocouple 78 detects the presence of heat from the burner section 72 whereby a shut-off valve 82 controlled thereby remains open allowing fuel to continue flow from fuel source 22 through conduit 71 to burner 72. In the event the thermocouple 78 fails to detect adequate heat from the burner section 72, shut-off valve 82 is closed and prevents the flow of fuel from fuel source 22, shutting off heater 10. Initial ignition is accomplished by activating a pilot switch 80 which overrides the action of the thermocouple 78 and the shut-off valve 82 until the fuel can be ignited and combustion is sufficient enough for thermocouple 78 to permit continued operation.

Operation of water heater 10, as shown in FIGS. 1 through 4, will now be described. Water inlet conduit 30 is immersed into an unheated water source or may be connected to pressurized unheated water using threaded connector 32. If the unheated water is not already pressurized, the pump 42 is then activated through control switch 60.

Unheated water then flows into the housing 12 through the water inlet conduit 30. From the water inlet conduit 30, unheated water enters supply section 44 of pump 42, exits pump 42 through discharge section 46 and passes through heat exchanger 50, exiting through conduit 36 and shower head 40.

Actuator 26 opens valve 25 permitting fuel to flow through inlet section 20, through valve 25, and orifice 74 and port 26 in conduit 71 to burner section 72.

Pilot switch 80 is depressed to override the thermocouple 78, and an ignition source or flame is placed at burner section 72. Upon obtaining the production of heat from combustion of the fuel, the water is heated while passing through heat exchanger 50. Valve 25 may be adjusted to regulate the temperature as desired.

The present invention may include other embodiments in addition to those already described. By way of example only, a further embodiment may include the fuel inlet section 20, the gaseous fuel control system, and the burner section 72 connectable to a heat exchanger in, by way of example, a boat, camper, motor home or the like for heating water with an apparatus that occupies a minimum of space. Alternatively, an embodiment may include all of the components described as herein with the exception of the pump 42. This particular embodiment may be acceptable where the water to be heated will always be supplied to the water inlet conduit 30 or the inlet section 48 of the heat exchanger 50 at a pressure sufficient to operate the water heater 10 without the pump 42. In another example, a further embodiment may include all of the components described herein with the exception of the housing 12 for a permanent or semipermanent installation in a boat, motor home, or the like.

Although preferred embodiments of the invention have been described using specific terms, devices, and methods, such description is for illustrative purposes only. The words used are words of description rather than of limitation. It is to be understood that changes and variations may be made by those of ordinary skill in the art without departing from the spirit or the scope of the present invention, which is set forth in the following claims. In addition, it should be understood that aspects of the various embodiments may be interchanged both in whole or in part. Therefore, the spirit and scope of the appended claims should not be limited to the description of the preferred versions contained therein.

What is claimed is:

1. A water heater, comprising:

a burner section for generating heat;

a fuel inlet section for supplying fuel to the burner section, said fuel inlet section being connectable to a fuel source;

a gaseous fuel control system connecting the burner section and the fuel inlet section; said gaseous fuel control system including a conduit along which are located (i) a valve, located subsequent to flow to said fuel inlet section; (ii) an orifice received in said conduit and in communication with the valve and having an effective diameter in the range of about 0.010 inch to about 0.030 inch; (iii) a port defined by said conduit and in communication with the orifice and having an effective diameter in the range of about 0.010 inch to about 0.030 inch; whereby fuel flowing from the fuel inlet section to the burner section may be controlled;

a heat exchanger, said heat exchanger having an inlet section and an outlet section whereby water may flow through the heat exchanger; and wherein the burner section is located proximate to said inlet section of said heat exchanger for heating water passing through the heat exchanger;

a conically-shaped interior coil conduit, said coil having a first end and a second end, the diameter of said coil decreasing along with the coil axis from said first end to said second end;

a cap located proximate said second end of said conically-shaped interior coil; and, an exterior coil conduit, located about said interior coil conduit and in fluid communication therewith.

2. A water heater, comprising a housing;

a water inlet conduit, through which water to be heated may enter the housing;

a pump, located within the housing, having a supply section and a discharge section, said supply section in fluid communication with the water inlet conduit;

a battery, located within the housing, and in operative association with said pump for providing power thereto;

a heat exchanger, located within the housing, having an inlet section and an outlet section, wherein the inlet section is in fluid communication with the discharge section of the pump, said heat exchanger comprising (i) a conically-shaped interior coil conduit, said coil having a first end and a second end, the diameter of said coil decreasing along the coil axis from said first end to said second end; (ii) a cap located proximate said second end of said conically-shaped interior coil; and, (iii) an exterior coil conduit, located about said interior coil and in fluid communication therewith;

a water outlet conduit, said conduit being in fluid communication with said outlet section of the heat exchanger, whereby heated water may exit the housing;

a burner section located within the housing and proximate to said inlet section of said heat exchanger;

a fuel inlet section for supplying fuel to the burner section, said fuel inlet section being connectable to a fuel source; and, a gaseous fuel control system connecting the burner section and the fuel inlet section; said gaseous fuel control system including a conduit along which are located (i) a valve, located subsequent in flow to said fuel inlet section; (ii) an orifice received in said conduit and in communication with the valve and having an effective diameter in the range of about 0.010 inch to about 0.030 inch; (iii) a port defined by said conduit and in communication with the orifice and having an effective diameter in the range of about 0.010 inch to about 0.030 inch; whereby fuel flowing from the fuel inlet section to the burner section may be controlled.

3. A water heater of claim 2, wherein said burner section is circular and has an effective diameter of about 0.5 inch to 3 inches and an effective length of no less than about 0.5 inch.

4. A water heater of claim 3, wherein the burner section defines an aperture in a wall thereof, said aperture having an effective diameter of from about 0.25 inch to about 0.5 inch.

5. A water heater of claim 2, wherein said orifice has an effective diameter of about 0.013 inch.

6. A water heater of claim 2, wherein said port has an effective diameter of about 0.018 inch.

7. A water heater of claim 2, further comprising a fuel source resealably connected to the fuel inlet section.

8. A water heater of claim 7, wherein said fuel source is a container of propane.

9. A water heater of claim 2, further comprising a handle, attached to said housing, whereby said water heater may be lifted and transported.

10. A water heater of claim 2, further comprising a solar panel recharger, connectable to said battery, whereby said battery may be recharged.

11. A water heater of claim 2, further comprising a shower head in fluid communication with the water outlet conduit, whereby a shower of heated water may be released.

12. A water heater of claim 2, further comprising a thermocouple located proximate the burner section; and, a shut-off valve in said conduit of said gaseous fuel control system, said shut-off valve being operatively associated with said thermocouple to be controlled thereby, whereby fuel flow is shut-off in the event adequate heat from combustion is not sensed by said thermocouple.

13. A water heater of claim 2, wherein said pump is structured to allow water flow through the pump when the pump is powered and when the pump is not powered.

14. A water heater, comprising:

a housing;

a water inlet conduit, through which water to be heated may enter the housing;

a heat exchanger, located within the housing, having an inlet section and an outlet section, wherein the inlet section is in fluid communication with the water inlet conduit, said heat exchanger comprising (i) a conically-shaped interior coil conduit, said coil having a first end and a second end, the diameter of said coil decreasing along the coil axis from said first end to said second end; (ii) a cap, said cap located proximate said second end of said conically-shaped interior coil; and, (iii) an exterior coil conduit, located about said interior coil and in fluid communication therewith;

a water outlet conduit, in fluid communication with said outlet section of said heat exchanger, whereby heated water may exit the housing;

a burner section located within the housing and proximate to said inlet section of said heat exchanger;

a fuel inlet section for supplying fuel to the burner section, said fuel inlet section being connectable to a fuel source; and, a gaseous fuel control system connecting the burner section and the fuel inlet section; said gaseous fuel control system including a conduit along which are located (i) a valve, located subsequent in flow to said fuel inlet section; (ii) an orifice received in said conduit and in communication with the valve and having an effective diameter in the range of about 0.010 inch to about 0.030 inch; (iii) a port defined by said conduit and in communication with the orifice and having an effective diameter in the range of about 0.010 inch to about 0.030 inch; whereby fuel flowing from the fuel inlet section to the burner section may be controlled.

15. A water heater of claim 14, wherein said burner section is circular and has an effective diameter of about 0.5 inch to 3 inches and an effective length of no less than about 0.5 inch.

16. A water heater of claim 15, wherein the burner section defines an aperture in a wall thereof, said aperture having an effective diameter of from about 0.25 inch to about 0.5 inch.

17. A water heater of claim 14, wherein said orifice has an effective diameter of about 0.013 inch.

18. A water heater of claim 14, wherein said port as an effective diameter of about 0.018 inch.

19. A water heater of claim 14, further comprising a fuel source resealably connected to said fuel inlet section.

20. A water heater of claim 19, wherein said fuel source is a container of propane.

21. A water heater of claim 14, further comprising a handle, attached to said housing.

22. A water heater of claim 14, further comprising a solar panel recharger, connectable to said battery, whereby said battery may be recharged.

23. A water heater of claim 14, further comprising a shower head in fluid communication with said water outlet conduit, whereby a shower of heated water may be released.

24. A water heater of claim 14, further comprising a thermocouple located proximate the burner section; and, a shut-off valve in said conduit of said gaseous fuel control system, said shut-off valve being operatively associated with said thermocouple to be controlled thereby, whereby fuel flow is shut-off in the event adequate heat from combustion is not sensed by said thermocouple.

25. A water heater, comprising:

a water inlet conduit, through which water may be supplied to the water heater;

a pump, having a supply section and a discharge section, said supply section in fluid communication with the water inlet conduit;

a battery in operative association with said pump for providing power thereto;

a heat exchanger, having an inlet section and an outlet section, wherein the inlet section is in fluid communication with the discharge section of the pump, said heat exchanger comprising (i) a conically-shaped interior coil conduit, said coil having a first end and a second end, the diameter of said coil decreasing along the coil axis from said first end to said second end; (ii) a cap, said cap located proximate said second end of said conically-shaped interior coil; and, (iii) an exterior coil conduit, located about said interior coil and in fluid communication therewith;

a water outlet conduit, said conduit being in fluid communication with said outlet section of the heat exchanger, whereby heated water may exit the water heater;

a burner section located proximate to said inlet section of said heat exchanger;

a fuel inlet section for supplying fuel to the burner section, said fuel inlet section being connectable to a fuel source; and, a gaseous fuel control system connecting the burner section and the fuel inlet section; said gaseous fuel control system including a conduit along which are located (i) a valve, located subsequent in flow to said fuel inlet section; (ii) an orifice received in said conduit and in communication with the valve and having an effective diameter in the range of about 0.010 inch to about 0.030 inch; (iii) a port defined by said conduit and in communication with the orifice and having an effective diameter in the range of about 0.010 inch to about 0.030 inch; whereby fuel flowing from the fuel inlet section to the burner section may be controlled.

26. A water heater of claim 25, wherein said burner section is circular and has an effective diameter of about 0.5 inch to 3 inches and an effective length of no less than about 0.5 inch.

27. A water heater of claim 25, wherein the burner defines an aperture in a wall thereof, said aperture having an effective diameter of from about 0.25 to about 0.5 inch.

28. A water heater of claim 25, wherein said orifice has an effective diameter of about 0.013 inch.

29. A water heater of claim 25, wherein said port as an effective diameter of about 0.018 inch.

30. A water heater of claim 25, further comprising a fuel source resealably connected to said fuel inlet section.

31. A water heater of claim 30, wherein said fuel source is a container of propane.

32. A water heater of claim 25, further comprising a solar panel recharger, connectable to said battery, whereby said battery may be recharged.

33. A water heater of claim 25, further comprising a shower head in fluid communication with said water outlet conduit, whereby a shower of heated water may be released.

34. A water heater of claim 25, further comprising a thermocouple located proximate the burner section; and, a shut-off valve in said conduit of said gaseous fuel control system, said shut-off valve being operatively associated with said thermocouple to be controlled thereby, whereby fuel flow is shut-off in the event adequate heat from combustion is not sensed by said thermocouple.

* * * * *